US010815544B2

(12) United States Patent
Wang et al.

(10) Patent No.: US 10,815,544 B2
(45) Date of Patent: Oct. 27, 2020

(54) HIGH FRICTION ROLLING OF THIN METAL STRIP

(71) Applicant: NUCOR CORPORATION, Charlotte, NC (US)

(72) Inventors: Tao Wang, Germantown, TN (US); Kishlay Mishra, Memphis, TN (US); Jeffery Edward Keffer, Blytheville, AR (US)

(73) Assignee: Nucor Corporation, Charlotte, NC (US)

( * ) Notice: Subject to any disclaimer, the term of this patent is extended or adjusted under 35 U.S.C. 154(b) by 0 days.

(21) Appl. No.: 16/376,726

(22) Filed: Apr. 5, 2019

(65) Prior Publication Data

US 2019/0309383 A1 Oct. 10, 2019

Related U.S. Application Data

(60) Provisional application No. 62/654,311, filed on Apr. 6, 2018.

(51) Int. Cl.

| | |
|---|---|
| ***C21D 8/02*** | (2006.01) |
| ***B21B 45/02*** | (2006.01) |
| ***C21D 9/46*** | (2006.01) |
| ***B21B 27/10*** | (2006.01) |
| ***B21B 45/00*** | (2006.01) |

(Continued)

(52) U.S. Cl.

CPC ..... *C21D 8/0226* (2013.01); *B21B 27/106* (2013.01); *B21B 45/004* (2013.01); *B21B 45/0239* (2013.01); *C21D 9/46* (2013.01); *B21B 2003/001* (2013.01); *B21B 2003/005* (2013.01); *C21D 2211/002* (2013.01); *C21D 2211/005* (2013.01); *C22C 38/02* (2013.01); *C22C 38/04* (2013.01); *C22C 38/06* (2013.01); *C22C 38/12* (2013.01); *C22C 38/14* (2013.01); *C22C 38/42* (2013.01); *C22C 38/60* (2013.01)

(58) Field of Classification Search

None

See application file for complete search history.

(56) References Cited

U.S. PATENT DOCUMENTS

| | | | |
|---|---|---|---|
| 4,676,844 | A | 6/1987 | Satoh et al. |
| 5,636,543 | A | 6/1997 | Kajiwara et al. |

(Continued)

OTHER PUBLICATIONS

PCT/US2019/026036 International Search Report and Written Opinion dated Jul. 9, 2019, 7 pages.

(Continued)

*Primary Examiner* — Jenny R Wu

(74) *Attorney, Agent, or Firm* — Hahn Loeser & Parks LLP

(57) ABSTRACT

Described herein are thin metal strips having hot rolled exterior side surfaces characterized as being primarily or substantially free of all prior austenite grain boundaries, or at least primarily or substantially free of all prior austenite grain boundaries, and including elongated surface structure. As a result, because the prior austenite grain boundaries are not primarily or substantially present, all such prior austenite grain boundaries are not susceptible to grain boundary etching due to acid etching or pickling. In particular examples, the thin metal strips undergo hot rolling performed with a coefficient of friction equal to or greater than 0.20 with or without use of lubrication.

22 Claims, 9 Drawing Sheets

(51) Int. Cl.

| | |
|---|---|
| *B21B 3/00* | (2006.01) |
| *C22C 38/02* | (2006.01) |
| *C22C 38/04* | (2006.01) |
| *C22C 38/06* | (2006.01) |
| *C22C 38/14* | (2006.01) |
| *C22C 38/12* | (2006.01) |
| *C22C 38/60* | (2006.01) |
| *C22C 38/42* | (2006.01) |

(56) References Cited

U.S. PATENT DOCUMENTS

| | | | | |
|---|---|---|---|---|
| 5,666,837 | A * | 9/1997 | Kajiwara | B21B 13/023 72/14.4 |
| 6,348,108 | B1 * | 2/2002 | Yusa | C21D 7/13 148/320 |
| 2004/0016530 | A1 | 1/2004 | Schoen et al. | |
| 2010/0186856 | A1 | 7/2010 | Williams et al. | |
| 2010/0258217 | A1 | 10/2010 | Kuehmann et al. | |
| 2011/0303386 | A1 * | 12/2011 | Blejde | B21B 1/46 164/463 |
| 2013/0126120 | A1 | 5/2013 | Nooning et al. | |
| 2014/0014238 | A1 | 1/2014 | Carpenter et al. | |
| 2016/0177411 | A1 * | 6/2016 | Watson | B22D 11/001 148/541 |
| 2017/0240992 | A1 | 8/2017 | Watson et al. | |
| 2019/0161817 | A1 * | 5/2019 | Takenaka | H01F 1/16 |

OTHER PUBLICATIONS

Azushima, A., et al., "Prediction of effect of rolling speed on coefficient of friction in hot sheet rolling of steel using sliding rolling tribo-simulator", J. Mater. Process. Tech. (2009) doi: 10.1016/j.jmatprotec.2009.08.005, 6 pages.

Orowan, E., "The Calculation of Roll Pressure in Hot and Cold Flat Rolling", Proc. Institute of Mechanical Engineers, (1943) vol. 150, pp. 140-167.

Sun, W., et al., "Friction in the roll bite under various hot rolling conditions", In D. Hua, et al. (Eds), Symposium on Advanced Structural Steels and New Rolling Technologies, (2005) pp. 110-120. China: Northeastern University.

Abdelraouf-Allam, TM. Direct Hod Rolled Dual Phase Weathering Steel. Dissertation for the Degree of Masters of Science, iEHK Steel Institute, Rwthaachen University, Nov. 26, 2015, 99 pages.

* cited by examiner

HIGH FRICTION ROLLING OF THIN METAL STRIP

CROSS-REFERENCE TO RELATED APPLICATIONS

This application claims priority to, and the benefit of, U.S. Provisional Application No. 62/654,311 filed on Apr. 6, 2018 with the United States Patent Office, which is hereby incorporated by reference.

BACKGROUND AND SUMMARY

This invention relates to thin metal strips, and thin metal strips produced by continuous casting with a twin roll caster.

In a twin roll caster, molten metal is introduced between a pair of counter-rotated casting rolls that are cooled so that metal shells solidify on the moving roll surfaces and are brought together at a nip between them. The term "nip" is used herein to refer to the general region at which the rolls are closest together. The molten metal may be delivered from a ladle into a smaller vessel or series of smaller vessels from which it flows through a metal delivery nozzle located above the nip, forming a casting pool of molten metal supported on the casting surfaces of the rolls immediately above the nip and extending along the length of the nip. As the metal shells are joined and pass through the nip between the casting rolls, a thin metal strip is cast downwardly from the nip. Thereafter, the thin metal strip passes through a mill to hot roll the thin metal strip to attain a desired final thin metal strip thickness. While performing the hot rolling, the thin metal strip is lubricated to reduce the roll bite friction, which in turn reduces the rolling load and roll wear, as well as providing a smoother surface finish. For example, lubrication may take the form of oil, which is applied to rolls and/or thin metal strip, or oxidation scale formed along the exterior of the thin metal strip prior to hot rolling. By employing lubrication, hot rolling occurs in a low friction condition, where the coefficient of friction ($\mu$) for the roll bite is less than 0.20. After hot rolling, the thin metal strip undergoes a cooling process.

In these low friction conditions, after undergoing a pickling or acid etching process to remove oxidation scale, large prior austenite grain boundaries have been observed on the hot rolled exterior surfaces of cooled thin metal strips formed of martensitic steel. In particular, while the martensitic thin metal strips tested using dye penetrant techniques appeared crack free, after acid pickling of the same martensitic thin metal strips, the prior austenite grain boundaries are etched by the acid to form prior austenite grain boundary depressions. This etching may further cause a cracking phenomenon to occur along the etched grain boundaries and the resulting depressions. The resulting cracks and separations, which are more generally referred to as separations, can extend at least 5 microns in depth, and in certain instances 5 to 10 microns in depth, for example, while the depressions formed along etched grain boundaries extend a depth less than these cracks. Examples of this are shown in FIGS. 3A and 3B, where etched prior austenite grain boundaries 10 are visible (at 250× magnification) after having been hot rolled under low friction conditions at a coefficient of friction of below 0.20 and subsequently cooled and acid etched. This acid etching is intended to mimic the steel pickling process. In one example, steel pickling is performed using a solution containing 18% hydrochloric (HCl) acid with an inhibitor. In a more particular example, fresh hydrochloric acid (HCl) moves into a first tank containing 17.25%, the contents thereof then cascades into a second tank containing 7.1% HCl, the contents thereof then cascades into a third tank containing 2.5% HCl. With reference again to FIGS. 3A and 3B, it is observed that cracking and separations 12 are arranged along certain prior austenite grain boundaries 10.

Accordingly, there is a need to create a cast strip surface that is not susceptible to prior austenite grain boundary etching by acid or otherwise does not produce any cracking or separation along any prior austenite grain boundaries after having been hot rolled and cooled to form a thin metal strip, such as, for example, with martensitic thin metal strips.

Presently disclosed is a cast strip surface that is not susceptible to prior austenite grain boundary etching by acid or otherwise does not produce any cracking or separation along any prior austenite grain boundaries after having been hot rolled and cooled to form a thin metal strip. In one example, a method of making a carbon steel strip comprises assembling a pair of counter-rotatable casting rolls having casting surfaces laterally positioned to form a gap at a nip between the casting rolls through which a thin metal strip having a thickness of less than 5 mm can be cast; assembling a metal delivery system adapted to deliver molten metal above the nip to form a casting pool, the casting pool being supported on the casting surfaces of the pair of counter-rotatable casting rolls and confined at the ends of the casting rolls; delivering a molten metal to the metal delivery system; delivering the molten metal from metal delivery system above the nip to form the casting pool; counter rotating the pair of counter-rotatable casting rolls to form metal shells on the casting surfaces of the casting rolls that are brought together at the nip to deliver the thin metal strip downwardly, the thin metal strip having a thickness less than 5 mm; and hot rolling the thin metal strip using a pair of opposing work rolls, thereby creating opposing hot rolled exterior side surfaces of the thin metal strip primarily free of prior austenite grain boundaries and characterized as having a plurality of elongated surface structure formations formed by shear. The hot rolling may be performed with a coefficient of friction equal to or greater than 0.20 with or without the use of lubrication. After hot rolling the examples above, the opposing rolled exterior side surface of the thin metal strip are homogenous. In examples of the above, the surface roughness (Ra) of each of the opposing hot rolled exterior side surfaces is not more than 4 micrometers. In some examples of the above, the force applied to the thin metal strip during hot rolling is 600 to 2500 tons. In examples of the above, the thin metal strip translates, or advances, at a rate of 45 to 75 meters/minute while being hot rolled. In examples of the above, hot rolling may occur with the thin metal strip having a temperature of between 1050 to 1150° C.

In one example of the above, the thin metal strip, after cooling, is characterized as having a tensile strength of 1100 to 2100 MPa, a yield strength of 900 to 1800 MPa, and an elongation to break of 3.5% to 8%. In yet another example, the thin metal strip is characterized as having a tensile strength of at least 500 MPa, having a yield strength of at least 380 MPa, and having an elongation to break of at least 6% or 10%. In examples of the above, less than 50% of each opposing hot rolled exterior side surface contains prior austenite grain boundaries. In examples of the above, 10% or less of each opposing hot rolled exterior side surface contains prior austenite grain boundaries. In examples of the above, opposing hot rolled exterior side surfaces of the thin metal strip are at least substantially free of prior austenite grain boundaries. In examples of the above, each opposing hot rolled exterior side surface is free of prior austenite grain boundaries.

In the method of making a thin metal strip of the prior examples the molten metal may comprise, by weight, 0.18% to 0.40% carbon, 0.7% to 1.2% manganese, 0.10% to 0.50% silicon, 0 to 0.1% vanadium, 0 to 0.1% niobium, 0 to 0.1% sulfur, 0 to 0.2% phosphorus, 0 to 0.5% chromium, 0.5 to 1.0% nickel, 0 to 0.5% copper, 0 to 0.15% molybdenum, 0 to 0.1% titanium, and 0 to 0.01 nitrogen. Additionally, after the step of hot rolling, the method may comprise cooling the thin metal strip to a temperature equal to or less than a martensite start transformation temperature MS to thereby form martensite from prior austenite within the thin metal strip, resulting in the thin metal strip being a martensitic steel thin metal strip.

In yet another example of the method of making a thin metal strip of the prior examples the molten metal may comprise a majority of bainite, and fine oxide particles of silicon and iron distributed though the microstructure of an average precipitate size less than 50 nanometers. In such an example, the thin metal strips may include, by weight, less than 0.25% carbon, 0.20 to 2.0% manganese, 0.05 to 0.50% silicon, less than or equal to 0.008% aluminum, and at least one element selected from the group consisting of titanium between 0.01 and 0.20%, niobium between 0.05 and 0.20%, and vanadium between about 0.01 and 0.20%, which may result in a High Strength Low Alloy (HSLA) thin metal strip.

The method of the above examples may further comprise identifying that the thin metal strip contains too many prior austenite grain boundaries prior to hot rolling the thin metal strip; and increasing the coefficient of friction when hot rolling the thin metal strip to primarily or substantially eliminate all prior austenite grain boundaries or all prior austenite grain boundaries. Moreover, in each of the above examples, the plurality of elongated surface structure formations form a plateau.

In each of the above examples, the coefficient of friction may be increased by, for example, increasing the surface roughness of the casting surfaces of the work rolls, eliminating the use of any lubrication, reducing the amount of lubrication used, or electing to use a particular type of lubrication.

In an example of a carbon steel strip formed by the present disclosure, a carbon steel strip comprises a thickness less than 5 mm and opposing exterior side surfaces primarily free of all prior austenite grain boundary and characterized as having a plurality of elongated surface structure formations elongated in a common direction, said common direction being a direction of hot rolling. In an example of the thin metal strip, each of the opposing exterior side surfaces of the thin metal strip may be homogenous. In additional examples of the thin metal strips above, the surface roughness (Ra) of each of the opposing hot rolled exterior side surfaces is not more than 4 micrometers.

In one example of the thin metal strips above, the thin metal strip, after cooling, may be characterized as having a tensile strength of 1100 to 2100 MPa, a yield strength of 900 to 1800 MPa, and an elongation to break of 3.5 to 8%. In examples of the thin metal strips above, at least less than 50% of each opposing hot rolled exterior side surface contains prior austenite grain boundaries. In examples of the thin metal strips above, opposing hot rolled exterior side surfaces of the thin metal strip are at least substantially free of prior austenite grain boundaries. In examples of the thin metal strips above, each opposing hot rolled exterior side surface is free of prior austenite grain boundaries. In examples of the thin metal strips above, the thin metal strips include, by weight, 0.18% to 0.40% carbon, 0.7% to 1.2% manganese, 0.10% to 0.50% silicon, 0 to 0.1% vanadium, 0 to 0.1% niobium, 0 to 0.1% sulfur, 0 to 0.2% phosphorus, 0 to 0.5% chromium, 0.5 to 1.0% nickel, 0 to 0.5% copper, 0 to 0.15% molybdenum, 0 to 0.1% titanium, and 0 to 0.01 nitrogen; the hot rolled exterior side surfaces of the thin metal strip are substantially free of all prior austenite grain boundaries; and the thin metal strip is a martensitic steel thin metal strip.

In yet another example of the carbon steel strip above, the thin metal strip may be characterized as having a microstructure comprising a majority of bainite, and fine oxide particles of silicon and iron distributed though the microstructure of an average precipitate size less than 50 nanometers. The thin metal strip may be further characterized as having a tensile strength of at least 500 MPa, having a yield strength of at least 380 MPa, and having an elongation to break of at least 6% or 10%. In such an example, the thin metal strips may include, by weight, less than 0.25% carbon, 0.20 to 2.0% manganese, 0.05 to 0.50% silicon, less than or equal to 0.008% aluminum, and at least one element selected from the group consisting of titanium between 0.01 and 0.20%, niobium between 0.05 and 0.20%, and vanadium between about 0.01 and 0.20%, which may result in a High Strength Low Alloy (HSLA) thin metal strip.

In each of the examples of the thin metal strips above, each thin metal strip may be formed by the methods or processes additionally described above.

BRIEF DESCRIPTION OF THE DRAWINGS

FIG. 14 is an illustrative example of a phase diagram for a carbon steel.

DETAILED DESCRIPTION

Figure 1:
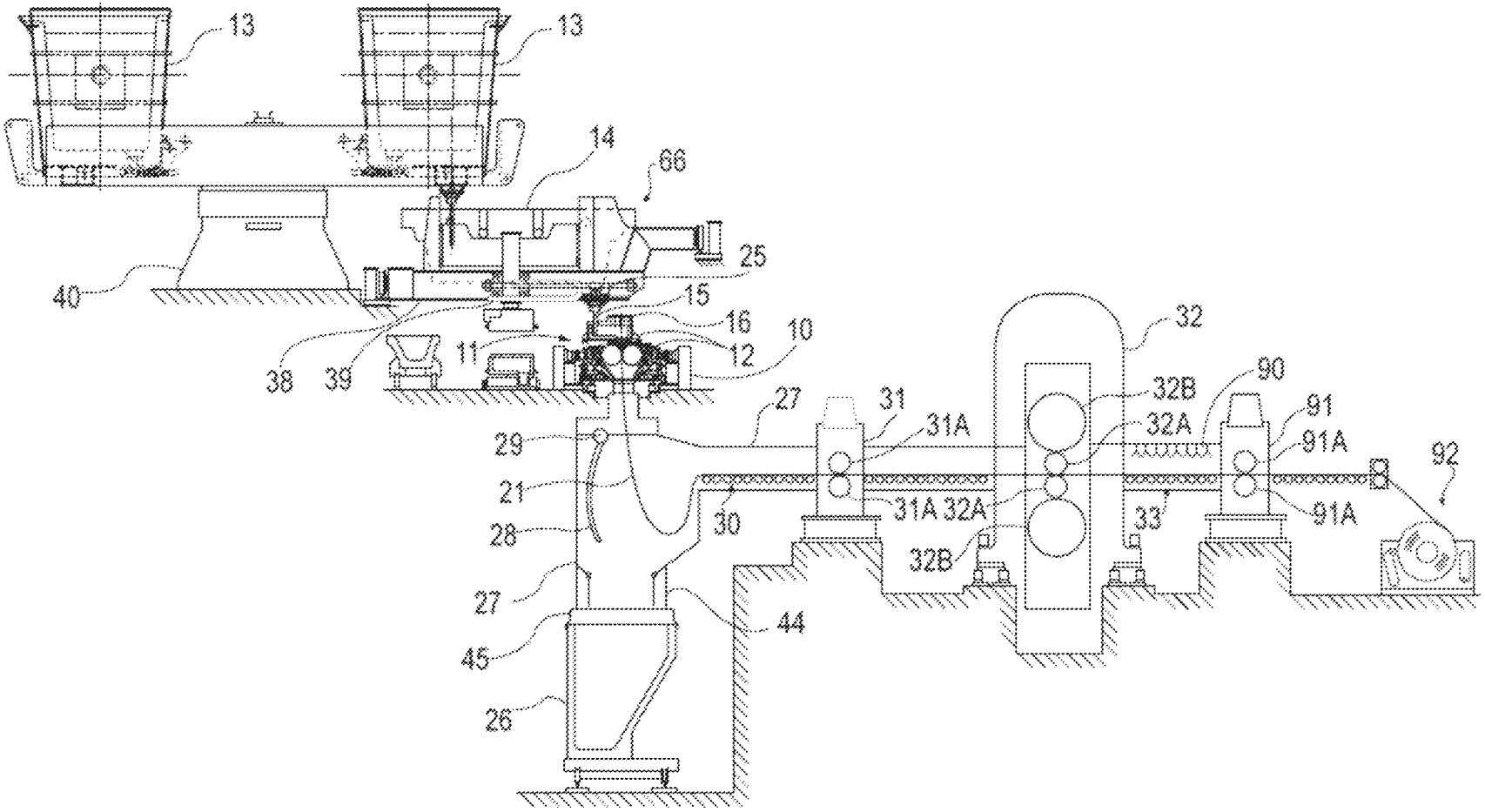
FIG. 1 is a diagrammatical side view of a twin roll caster plant in accordance with one or more aspects of the present invention.

Described herein are thin metal strips characterized as having hot rolled exterior side surfaces characterized as being primarily or substantially free of all prior austenite grain boundaries, and including elongated surface structure. As a result, because the prior austenite grain boundaries are not primarily or substantially present, all such prior austenite grain boundaries are not susceptible to prior austenite grain boundary etching due to acid etching or pickling. Primarily free means less than 50% of each opposing hot rolled exterior side surface contains prior austenite grain boundaries. Substantially free means 10% or less of each opposing hot rolled exterior side surface contains prior austenite grain boundaries. Prior austenite grain boundaries form the interface between grains, where grains form crystallites in a polycrystalline material. Prior austenite grain boundaries form the interface between prior austenite grains. Determining the presence of prior austenite grain boundaries may be performed using any known technique, which includes use of light optical microscopy (LOM), electron backscatter diffraction (EBSD), transmission electron microscopy (TEM), scanning electron microscopy (SEM), and AFM (atomic force microscopy). Any such technique may be employed to identify prior austenite grain boundaries, which may include the identification of grains, before or after acid etching or pickling the hot rolled surface, where after acid etching or pickling the prior austenite grain boundaries form depressions referred to as prior austenite grain boundary depressions. The opposing hot rolled exterior sides define the thickness of the thin metal strip, while prior austenite grain boundary depressions form a void or cavity extending into the strip thickness at a prior austenite grain boundary. The prior austenite grain boundaries are prior austenite grain boundaries in martensitic steel thin metal strips. Determining whether or not a hot rolled surface is primarily or substantially free is discussed further below.

Methods for forming the same are also disclosed herein, and may comprise any strip casting process. In particular examples, a method for producing a thin metal strip having a thickness of less than 5 mm includes casting a thin metal strip by way of a twin roll casting process. While any twin roll casting process may be employed, in particular examples, a twin roll casting process includes:

(1) assembling a pair of counter-rotatable casting rolls having casting surfaces laterally positioned to form a gap at a nip between the casting rolls through which a thin metal strip having a thickness of less than 5 mm can be cast, (2) assembling a metal delivery system adapted to deliver molten metal above the nip to form a casting pool, the casting pool being supported on the casting surfaces of the pair of counter-rotatable casting rolls and confined at the ends of the casting rolls, (3) delivering a molten steel to the metal delivery system;

(4) delivering the molten metal from metal delivery system above the nip to form the casting pool; and, (5) counter rotating the pair of counter-rotatable casting rolls to form metal shells on the casting surfaces of the casting rolls that are brought together at the nip to deliver the thin metal strip downwardly, the thin metal strip having a thickness less than 5 mm.

It is appreciated that the molten metal employed in the methods, as with the resulting thin metal strip, may form any of a variety of metal material, including any steel and steel alloy The methods described herein, and the products or thin metal strips made thereby, are for use with carbon steel strips. A carbon steel, by example, is a steel having a microstructure formed from prior austenite. In one specific example, the molten metal is steel comprising, by weight, 0.18% to 0.40% carbon, 0.7% to 1.2% manganese, 0.10% to 0.50% silicon, 0 to 0.1% vanadium, 0 to 0.1% niobium, 0 to 0.1% sulfur, 0 to 0.2% phosphorus, 0 to 0.5% chromium, 0.5 to 1.0% nickel, 0 to 0.5% copper, 0 to 0.15% molybdenum, 0 to 0.1% titanium, and 0 to 0.01 nitrogen, which may result in a martensitic steel thin metal strip. The remainder of the content may comprise any other material if at all, including, without limitation, iron and other impurities that may result from melting. In yet another example, the molten metal is steel comprising, by weight, less than 0.25% carbon, 0.20 to 2.0% manganese, 0.05 to 0.50% silicon, less than or equal to 0.008% aluminum, and at least one element selected from the group consisting of titanium between 0.01 and 0.20%, niobium between 0.05 and 0.20%, and vanadium between about 0.01 and 0.20%, which may result in a High Strength Low Alloy (HSLA) thin metal strip. More generally stated, other steels and steel alloys may be formed according to these methods, including for example and without limitation martensitic steels, high strength low alloy (HSLA) steels, and steels having an elevated niobium content such as the kind that is illustrated and described in some detail in U.S. Pat. No. 9,999,918 which is hereby incorporated by reference to illustrate examples of a carbon steel strip.

Figure 2:
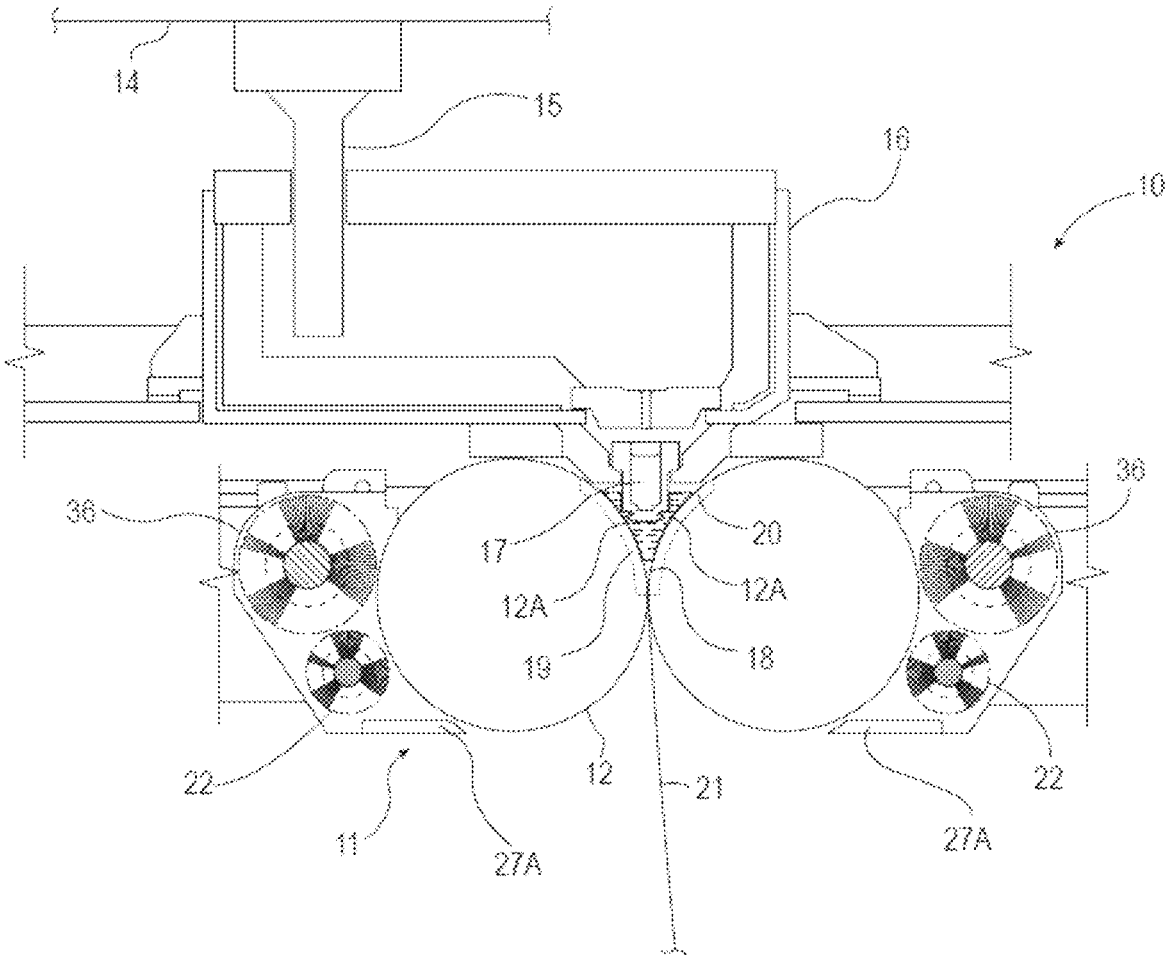
FIG. 2 is a partial sectional view through the casting rolls mounted in a roll cassette in the casting position of the caster of FIG. 1, in accordance with one or more aspects of the present invention.

Any manner of forming a thin metal strip may be employed to provide a thin metal strip for hot rolling. With reference to FIGS. 1 and 2, an exemplary strip casting system is shown. In this example, the strip casting system is a continuous twin roll casting system. The twin roll caster comprises a main machine frame 10 that that stands up from the factory floor and supports a roll cassette module 11 including a pair of counter-rotatable casting rolls 12 mounted therein. The casting rolls 12 having casting surfaces 12A are laterally positioned to form a nip 18 there between. Molten metal is supplied from a ladle 13 through a metal delivery system, which includes a movable tundish 14 and a transition piece or distributor 16. From the distributor 16, molten metal flows to at least one metal delivery nozzle 17 (also referred to as a core nozzle) positioned between the casting rolls 12 above the nip 18. Molten metal discharged from the delivery nozzle 17 forms a casting pool 19 of molten metal supported on the casting surfaces 12A of the casting rolls 12 above the nip 18. This casting pool 19 is laterally confined in the casting area at the ends of the casting rolls 12 by a pair of side closures or plate side dams 20 (shown in dotted line in FIG. 2). The upper surface of the casting pool 19 (generally referred to as the "meniscus" level) typically rises above the bottom portion of the delivery nozzle 17 so that the lower part of the delivery nozzle 17 is immersed in the casting pool 19. The casting area above the casting pool 19 provides the addition of a protective atmosphere to inhibit oxidation of the molten metal before casting.

The ladle 13 typically is of a conventional construction supported on a rotating turret 40. For metal delivery, the ladle 13 is positioned above a movable tundish 14 in the casting position as shown in FIG. 1 to deliver molten metal to movable tundish 14. The movable tundish 14 may be positioned on a tundish car 66 capable of transferring the tundish from a heating station (not shown), where the tundish is heated to near a casting temperature, to the casting position. A tundish guide, such as rails, may be positioned beneath the tundish car 66 to enable moving the movable tundish 14 from the heating station to the casting position. An overflow container 38 may be provided beneath the movable tundish 14 to receive molten material that may spill from the tundish. As shown in FIG. 1, the overflow container 38 may be movable on rails 39 or another guide such that the overflow container 38 may be placed beneath the movable tundish 14 as desired in casting locations.

The movable tundish 14 may be fitted with a slide gate 25, actuable by a servo mechanism, to allow molten metal to flow from the tundish 14 through the slide gate 25, and then through a refractory outlet shroud 15 to a transition piece or distributor 16 in the casting position. From the distributor 16, the molten metal flows to the delivery nozzle 17 positioned between the casting rolls 12 above the nip 18.

With reference to FIG. 2, the casting rolls 12 are internally water cooled so that as the casting rolls 12 are counter-rotated, shells solidify on the casting surfaces 12A as the casting rolls move into and through the casting pool 19 with each revolution of the casting rolls 12. The shells are brought together at the nip 18 between the casting rolls 12 to produce solidified thin cast strip product 21 delivered downwardly from the nip 18. The gap between the casting rolls is such as to maintain separation between the solidified shells at the nip and form a semi-solid metal in the space between the shells through the nip, and is, at least in part, subsequently solidified between the solidified shells within the cast strip below the nip. In one example, the casting rolls 12 may be configured to provide a gap at the nip 18 through which thin cast strip 21 less than 5 mm in thickness can be cast. Counter rotating the casting rolls 12 to form metal shells on the casting surfaces 12A of the casting rolls 12 may occur, for example, at a heat flux greater than 10 $MW/m^2$.

With continued reference to FIG. 1, at the start of the casting campaign, a short length of imperfect strip is typically produced as casting conditions stabilize. After continuous casting is established, the casting rolls 12 are moved apart slightly and then brought together again to cause the leading end of the thin strip to break away forming a clean head end for the following strip to cast. The imperfect material drops into a scrap receptacle 26, which is movable on a scrap receptacle guide. The scrap receptacle 26 is located in a scrap receiving position beneath the caster and forms part of a sealed enclosure 27 as described below. The enclosure 27 is typically water cooled. At this time, a water-cooled apron 28 that normally hangs downwardly from a pivot 29 to one side in the enclosure 27 is swung into position to guide the clean end of the strip 21 onto the guide table 30 and feed the strip 21 through the pinch roll stand 31. The apron 28 is then retracted back to the hanging position to allow the strip 21 to hang in a loop beneath the casting rolls in enclosure 27 before the strip passes to the guide table 30 where it engages a succession of guide rollers.

The sealed enclosure 27 is formed by a number of separate wall sections that fit together with seal connections to form a continuous enclosure that permits control of the atmosphere within the enclosure. Additionally, the scrap receptacle 26 may be capable of attaching with the enclosure 27 so that the enclosure is capable of supporting a protective atmosphere immediately beneath the casting rolls 12 in the casting position. The enclosure 27 includes an opening in the lower portion of the enclosure, lower enclosure portion 44, providing an outlet for scrap to pass from the enclosure 27 into the scrap receptacle 26 in the scrap receiving position. The lower enclosure portion 44 may extend downwardly as a part of the enclosure 27, the opening being positioned above the scrap receptacle 26 in the scrap receiving position. As used in the specification and claims herein, "seal", "sealed", "sealing", and "sealingly" in reference to the scrap receptacle 26, enclosure 27, and related features may not be completely sealed so as to prevent atmospheric leakage, but rather may provide a less than perfect seal appropriate to allow control and support of the atmosphere within the enclosure as desired with some tolerable leakage.

With continued reference to FIG. 1, a rim portion 45 may surround the opening of the lower enclosure portion 44 and may be movably positioned above the scrap receptacle, capable of sealingly engaging and/or attaching to the scrap receptacle 26 in the scrap receiving position. The rim portion 45 may be movable between a sealing position in which the rim portion engages the scrap receptacle, and a clearance position in which the rim portion 45 is disengaged from the scrap receptacle. Alternately, the caster or the scrap receptacle may include a lifting mechanism to raise the scrap receptacle into sealing engagement with the rim portion 45 of the enclosure, and then lower the scrap receptacle into the clearance position. When sealed, the enclosure 27 and scrap receptacle 26 are filled with a desired gas, such as nitrogen, to reduce the amount of oxygen in the enclosure and provide a protective atmosphere for the strip 21.

With reference now to both FIGS. 1 and 2, the enclosure 27 may include an upper collar portion 27A supporting a protective atmosphere immediately beneath the casting rolls in the casting position. When the casting rolls 12 are in the casting position, the upper collar portion is moved to the extended position closing the space between a housing portion adjacent the casting rolls 12, as shown in FIG. 2, and the enclosure 27. The upper collar portion may be provided within or adjacent the enclosure 27 and adjacent the casting rolls, and may be moved by a plurality of actuators (not shown) such as servo-mechanisms, hydraulic mechanisms, pneumatic mechanisms, and rotating actuators.

After the thin metal strip is formed (cast) using any desired process, such as the strip casting process described above in conjunction with FIGS. 1 and 2, the strip is hot rolled and cooled to form a desired thin metal strip having opposing hot rolled exterior side surfaces at least primarily or substantially free of prior austenite grain boundaries. In particular instances, the methods of forming a thin metal strip further include hot rolling the thin metal strip using a pair of opposing work rolls generating a heightened coefficient of friction (μ) sufficient to generate opposing hot rolled exterior side surfaces of the thin metal strip characterized as being primarily or substantially free of all prior austenite grain boundaries or free of all prior austenite grain boundaries, and being characterized as having elongated surface structure associated with surface smear patterns formed under shear through plastic deformation. In certain instances, the pair of opposing work rolls generate a coefficient of friction (μ) equal to or greater than 0.20, equal to or greater than 0.25 or equal to or greater than 0.268, each with or without use of lubrication at a temperature above the $A_{r3}$ temperature. It is appreciated that these methods of forming the desired thin metal strip by hot rolling at a heightened coefficient of friction may be performed after identifying that previously formed thin metal strip contained prior austenite grain boundaries, or too many prior austenite grain boundaries. As a result, the previously described process for forming hot rolled surfaces being primarily or substantially free of all prior austenite grain boundaries or free of all prior austenite grain boundaries and containing a plurality of elongated surface structure formations was performed by hot rolling at an increased coefficient of friction. In other words, after identifying that a hot rolled surface contained prior austenite grain boundaries, or too many prior austenite grain boundaries, subsequent hot rolling of thin metal strip is performed with an increased coefficient of friction. It is appreciated that the coefficient of friction may be increased by increasing the surface roughness of the casting surfaces of the work rolls, eliminating the use of any lubrication, reducing the amount of lubrication used, and/or electing to use a particular type of lubrication.

After hot rolling, the hot rolled thin metal strip is cooled. It is appreciated that cooling may be accomplished by any known manner. In certain instances, when cooling the thin metal strip, the thin metal strip is cooled to a temperature equal to or less than a martensite start transformation temperature $M_S$ to thereby form martensite from prior austenite within the thin metal strip.

Hot rolling is performed using one or more pairs of opposing work rolls. Work rolls are commonly employed to reduce the thickness of a substrate, such as a plate, strip, or sheet. This is achieved by passing the substrate through a gap arranged between the pair of work rolls, the gap being less than the thickness of the substrate. The gap is also referred to as a roll bite. During hot working, a force is applied to the substrate by the work rolls, thereby applying a hot rolling force on the substrate to thereby achieve a desired reduction in the substrate thickness. In doing so, friction is generated between the substrate and each work roll as the substrate translates, or advances, through the gap. This friction is referred to as roll bite friction, or bite friction.

Traditionally, the desire is to reduce the bite friction during hot rolling of metal plates and sheets. By reducing the bite friction (and therefore the friction coefficient), the rolling load and roll wear are reduced to extend the life of the work rolls. Various techniques have been employed to reduce roll bite friction and the coefficient of friction. In certain exemplary instances, the thin metal strip is lubricated to reduce the roll bite friction. Lubrication may take the form of oil, which is applied to rolls and/or thin metal strip, or of oxidation scale formed along the exterior of the thin metal strip prior to hot rolling. By employing lubrication, hot rolling occurs in a low friction condition, where the coefficient of friction (μ) for the roll bite is less than 0.20.

Contrary to traditional hot rolling methods, the methods herein employ higher roll bite friction to achieve the desired hot rolled surface. Specifically, it is desired to apply a sufficient amount of shear to the substrate during hot rolling by employing a heightened coefficient of friction sufficient to form opposing hot rolled exterior side surfaces of the thin metal strip characterized as being primarily or substantially free of all prior austenite grain boundaries or free of all prior austenite grain boundaries, and being characterized as having elongated surface structure associated with surface smear patterns formed under shear through plastic deformation. It is appreciated that the requisite coefficient of friction employed to generate such hot rolled surfaces will vary based upon the conditions under which hot rolling occurs. It is appreciated that the actual measured coefficient of friction will vary based upon the methods employed for measuring or modelling. However, in sum, sufficiently increasing the coefficient of friction will generate the shearing needed to generate the desired hot rolled surface as described herein. As is understood by one of ordinary skill, the coefficient of friction may be affected or altered by various factors or parameters. In particular, the coefficient of friction may be increased by reducing the amount of lubrication employed by the work rolls and/or by using certain lubrication that is less effective in reducing the coefficient of friction, eliminating the use of any lubrication. Alternatively, all lubrication may be eliminated from use. Additionally, or separately, the surface roughness of the work rolls may be increased. Other mechanisms for increasing the coefficient of friction as may be known to one of ordinary skill may also be employed—additionally or separately from the mechanisms previously described.

Figure 12:
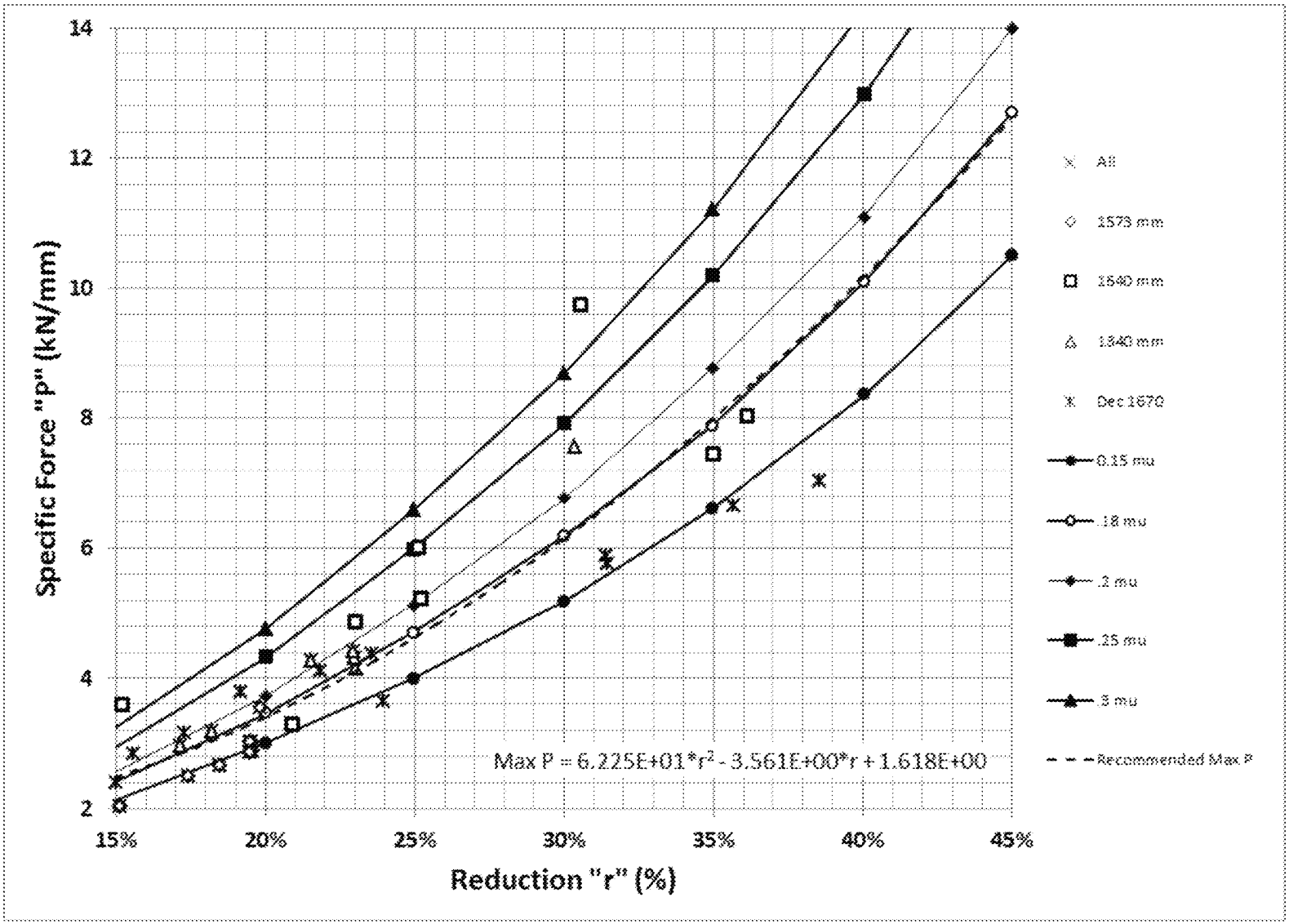
FIG. 12 is a coefficient of friction model chart created to determine the coefficient of friction for a particular pair of work rolls, specific mill force, and corresponding reduction.

In one example, the friction coefficient (μ) can be determined (actually or estimated) based upon a hot rolling model developed by HATCH for a particular set of work rolls. The model is shown in FIG. 12, providing thin metal strip thickness reduction in percent along the X-axis and the specific force "P" in kN/mm along the Y-axis. The specific force P is the normal (vertical) force applied to the substrate by the work rolls. The model includes five (5) curves each representing a coefficient of friction and providing a relationship between reduction and work roll forces. For each coefficient of friction, expected work roll forces are obtained based upon the measured reduction. In operation, during hot rolling, the targeted coefficient of friction is preset by adjustment of work roll lubrication, the target reduction is set by the desired strip thickness required at the mill exit to meet a specific customer order and the actual work roll force will be adjusted to achieve the target reduction. FIG. 12 shows typical forces required to achieve a target reduction for a specific coefficient of friction.

In certain exemplary instances, the coefficient of friction is equal to or greater than 0.20. In other exemplary instances, the coefficient of friction is at least or greater than 0.25, at least or greater than 0.268, or at least or greater than 0.27. It is appreciated that these friction coefficients are sufficient, under certain conditions for austenitic steel (which is the steel alloy employed in the examples shown in the figures), where during hot rolling, the steel is austenitic but after cooling martensite is formed having discernable prior austenite grains, to at least primarily or substantially eliminate prior austenite grain boundaries from hot rolled surfaces and to generate elongated surface features plastically formed by shear. As noted previously, various factors or parameters may be altered to attain a desired coefficient of friction under certain conditions. It is noted that for the coefficient of friction values previously described, for substrates having a thickness of 5 mm or less prior to hot rolling. The normal force applied to the substrate during hot rolling may be 600 to 2500 tons while the substrate enters the pair of work rolls and translates, or advances, at a rate of 45 to 75 m/min where the temperature of the substrate entering the work rolls is greater than 1050° C., and certain instances, up to 1150° C. For these coefficients of friction, the work rolls have a diameter of 400 to 600 mm. Of course, variations outside each of these parameter ranges may be employed as desired to attain different coefficients of friction as may be desired to achieve the hot rolled surface characteristics described herein.

It is appreciated that these coefficients of friction may be attained with or without the use of traditional lubrication, such as described above. In certain instances, it may be desirous to reduce or eliminate lubrication to increase the coefficient of friction. As stated previously, lubrication may consist of the application of oil to the working rolls and/or the thin metal strip and/or may consist of forming scale along the exterior sides of the thin metal strip through oxidation. To reduce or eliminate oxidation, after casting, the surrounding atmosphere or environment is controlled by reducing or eliminating oxygen, such as by increasing nitrogen or any other suitable non-oxygen gas.

As stated previously, hot rolling of the thin metal strip is performed while the thin metal strip is at a temperature above the $Ar_3$ temperature. The $Ar_3$ temperature is the temperature at which austenite begins to transform to ferrite during cooling. In other words, the $Ar_3$ temperature is the point of austenite transformation. The $Ar_3$ temperature is located a few degrees below the $A_3$ temperature. Below the $Ar_3$ temperature, alpha ferrite forms. These temperatures are shown in an exemplary CCT diagram in FIG. 13.

After hot rolling, the thin metal strip is cooled to a temperature equal to or less than a martensite start transformation temperature $M_S$, which may be performed using any known cooling technique, such as quenching, for example. It is appreciated that in cooling to form martensite, the entire strip may or may not be martensitic.

Exemplary hot rolling and cooling may be performed in any desired manner. For example, referring again to the example shown in FIG. 1, a thin cast steel strip 21 is shown passing from the casting rolls after formation/casting and across guide table 30 to a pinch roll stand 31, comprising pinch rolls 31A. Upon exiting the pinch roll stand 31, the thin cast strip may pass through a hot rolling mill 32, comprising a pair of work rolls 32A, and backup rolls 32B, forming a gap capable of hot rolling the cast strip delivered from the casting rolls, where the cast strip is hot rolled to reduce the strip to a desired thickness, improve the strip surface, and improve the strip flatness. The work rolls 32A have work surfaces relating to the desired strip profile across the work rolls. It is appreciated that one pair or multiple pairs of work rolls may be employed. Work rolls and rolling mills are distinguishable from pinch rolls, where a pair of work rolls apply sufficient forces to more substantially reduce the thickness of the strip while pinch rolls are employed to "grip" the strip to impart tension to control the translation of the strip. Much lower forces are applied to the strip by way of pinch rolls, and while these forces may still reduce the thickness of the strip, this reduction is substantially less than the reduction generated by work rolls.

After exiting the hot rolling mill 32, the hot rolled cast strip then passes onto a run-out table 33, where the strip may be cooled by contact with a coolant, such as water, supplied via water jets 90 or other suitable means, and by convection and radiation. In particular instances such as shown, the hot rolled strip may then pass through a second pinch roll stand 91 having rollers 91A to provide tension on the strip, and then to a coiler 92. The thickness of strip may be between about 0.3 and about 3 millimeters in thickness after hot rolling in certain instances, while other thicknesses may be provided as desired.

The strip 21 is passed through the hot mill to reduce the as-cast thickness before the strip 21 is cooled, such as to a temperature at which austenite in the steel transforms to martensite in particular examples. In particular instances, the hot solidified strip (the cast strip) may be passed through the hot mill while at an entry temperature greater than 1050° C., and in certain instances up to 1150° C. After the strip 21 exits the hot mill 32, the strip 21 is cooled such as, in certain exemplary instances, to a temperature at which the austenite in the steel transforms to martensite by cooling to a temperature equal to or less than the martensite start transformation temperature $M_S$. In certain instances, this temperature is ≤600° C., where the martensite start transformation temperature $M_S$ is dependent on the particular composition. Cooling may be achieved by any known methods using any known mechanism(s), including those described above. In certain instances, the cooling is sufficiently rapid to avoid the onset of appreciable ferrite, which is also influenced by composition. In such instances, for example, the cooling is configured to reduce the temperature of the strip 21 at the rate of about 100° C. to 200° C. per second.

Figure 13:
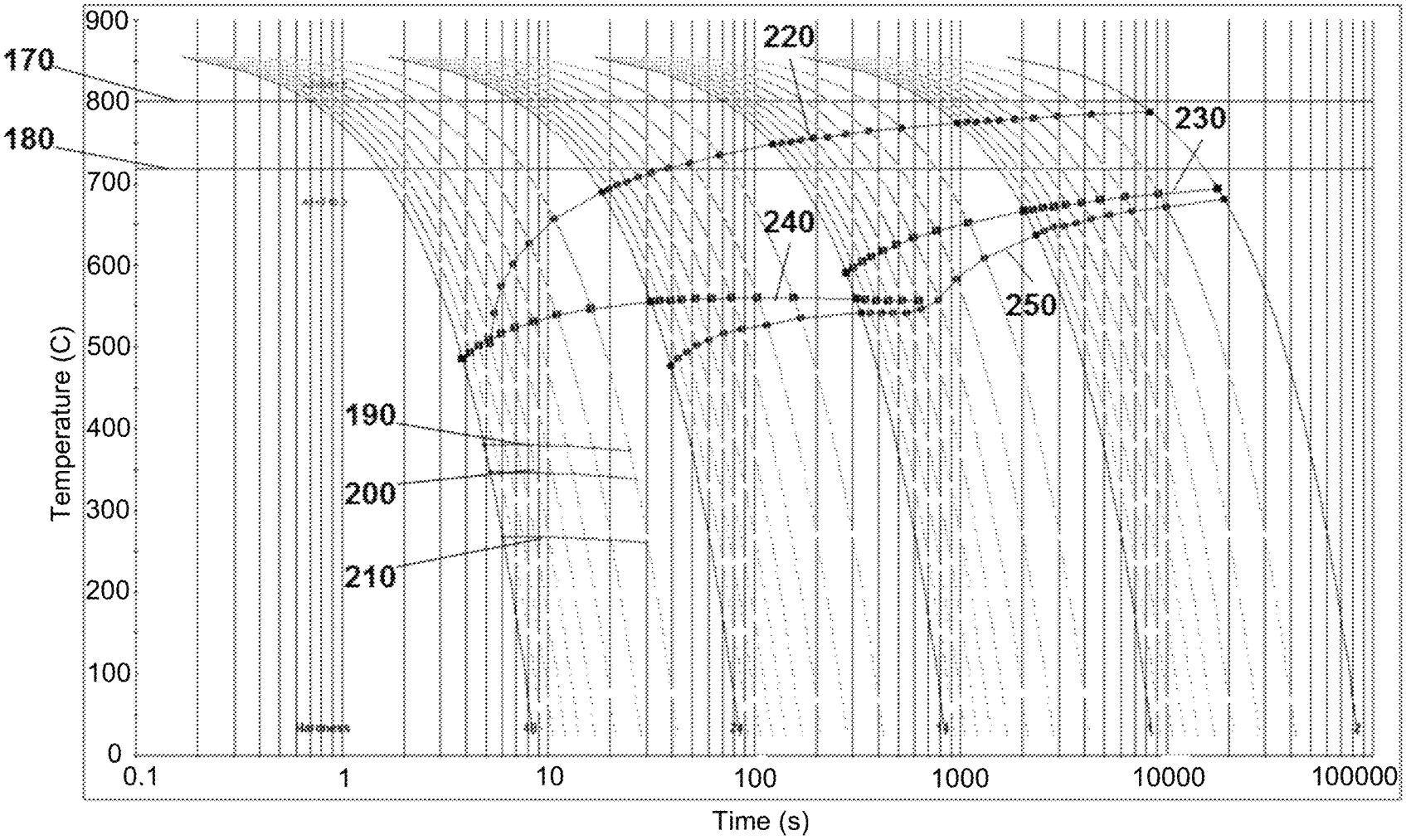
FIG. 13 is a continuous cool transformation (CCT) diagram for steel.

The interplay between transformation temperatures and cooling rates are typically presented in a CCT diagram (for example, see an exemplary CCT diagram in FIG. 13). As stated previously, hot rolling of the thin steel strip is performed while the thin steel strip is at a temperature above the $Ar_3$ temperature. The $Ar_3$ temperature is located a few degrees below the $A_3$ temperature. Below the $Ar_3$ temperature, alpha ferrite forms. In FIG. 13, $A_3$ 170 represents the upper temperature for the end of stability for ferrite in equilibrium. $Ar_3$ is the upper limit temperature for the end of stability for ferrite on cooling. More specifically, The $Ar_3$ temperature is the temperature at which austenite begins to transform to ferrite during cooling. In other words, the $Ar_3$ temperature is the point of austenite transformation. Comparatively, $A_1$ 180 represents the lower limit temperature for the end of stability for ferrite in equilibrium.

Still referring to FIG. 13, the ferrite curve 220 represents the transformation temperature producing a microstructure of 1% ferrite, the pearlite curve 230 represents the transformation temperature producing a microstructure of 1% pearlite, the austenite curve 250 represents the transformation temperature producing a microstructure of 1% austenite, and the bainite curve ($B_s$) 240 represents the transformation temperature producing a microstructure of 1% bainite. As previously described in greater detail, a martensite start transformation temperature $M_S$ is represented by the martensite curve 190 where martensite begins forming from prior austenite within the thin steel strip. Further illustrated by FIG. 13 is a 50% martensite curve 200 representing a microstructure having at least 50% martensite. Additionally, FIG. 13 illustrates a 90% martensite curve 210 representing a microstructure having at least 90% martensite.

In the exemplary CCT diagram shown in FIG. 13, the martensite start transformation temperature $M_S$ is shown. In passing through the cooler, the austenite in the strip 21 is transformed to martensite. Specifically, in this instance, cooling the strip 21 to below 600° C. causes a transformation of the coarse austenite wherein a distribution of fine iron carbides are precipitated within the martensite.

By virtue of hot rolling with a coefficient of friction equal to or greater than 0.20 and at a temperature above the $A_{r3}$ temperature, a thin metal strip is formed having opposing hot rolled exterior side surfaces (1) at least primarily or substantially free of all prior austenite grain boundary depressions and separations, and (2) having elongated surface structure. After cooling, in certain instances, a martensitic thin metal strip is characterized as having a tensile strength of 1100 to 2100 MPa, a yield strength of 900 to 1800 MPa, and an elongation to break of 3.5 to 8%.

As noted above, primarily free means less than 50% of each opposing hot rolled exterior side surface contains prior austenite grain boundaries or prior austenite grain boundary depressions after acid etching (pickling), while at least substantially free of all prior austenite grain boundaries or prior austenite grain boundary depressions means that 10% or less of each opposing hot rolled exterior side surface contains prior austenite grain boundaries or prior austenite grain boundary depressions after acid etching (pickling), where said depressions form etched prior austenite grain boundaries after acid etching (also known as pickling) to render the prior austenite grain boundaries visible at 250× magnification. In other instances, at least substantially free connotes that each opposing hot rolled exterior side surface is free, that is, completely devoid, of prior austenite grain boundaries, which includes being free of any prior austenite grain boundary depressions after acid etching. It is stressed that while prior austenite grain boundaries or prior austenite grain boundary depressions and separations arranged along prior austenite grain boundaries may exist within a thin metal strip after hot rolling using the improved techniques described herein (where hot rolling occurs at a temperature above the $A_{r3}$ temperature using roll bite coefficients of friction equal to or greater than 0.20, at least or greater than 0.25, at least or greater than 0.268, at least or greater than 0.27), these features are not primarily or substantially present along the exterior surface in the different examples described herein.

Figure 3A:
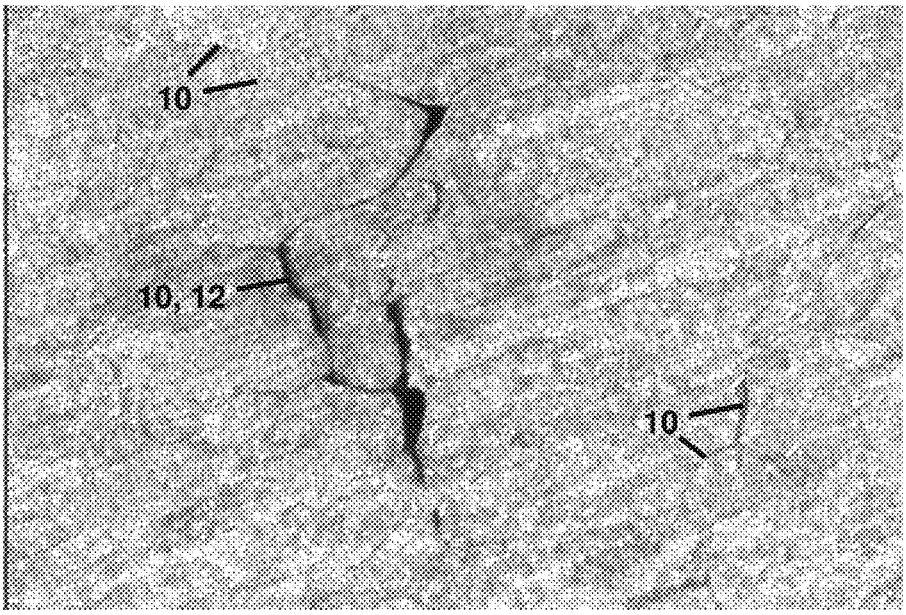
FIG. 3A is an image showing an acid etched hot rolled surface having at least 50% of prior austenite grain boundaries and cracking there along in a martensitic thin metal (steel) strip, taken at 250× magnification, where said strip was formed using the twin roll casting process described in association with FIGS. 1 and 2, where hot rolling was performed under low friction conditions (where the coefficient of friction was less than 0.20)
Figure 3B:
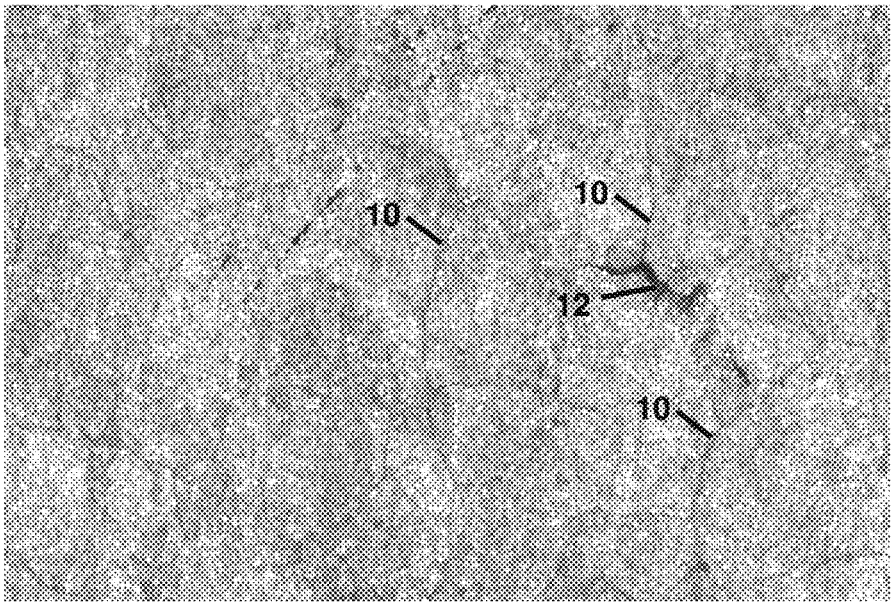
FIG. 3B is a second edited image showing an acid etched hot rolled surface having at least 50% of prior austenite grain boundaries and cracking there along in a martensitic thin metal (steel) strip, taken at 250× magnification, where said strip was formed using the twin roll casting process described in association with FIGS. 1 and 2, where hot rolling was performed under low friction conditions (where the coefficient of friction was less than 0.20)
Figure 4:
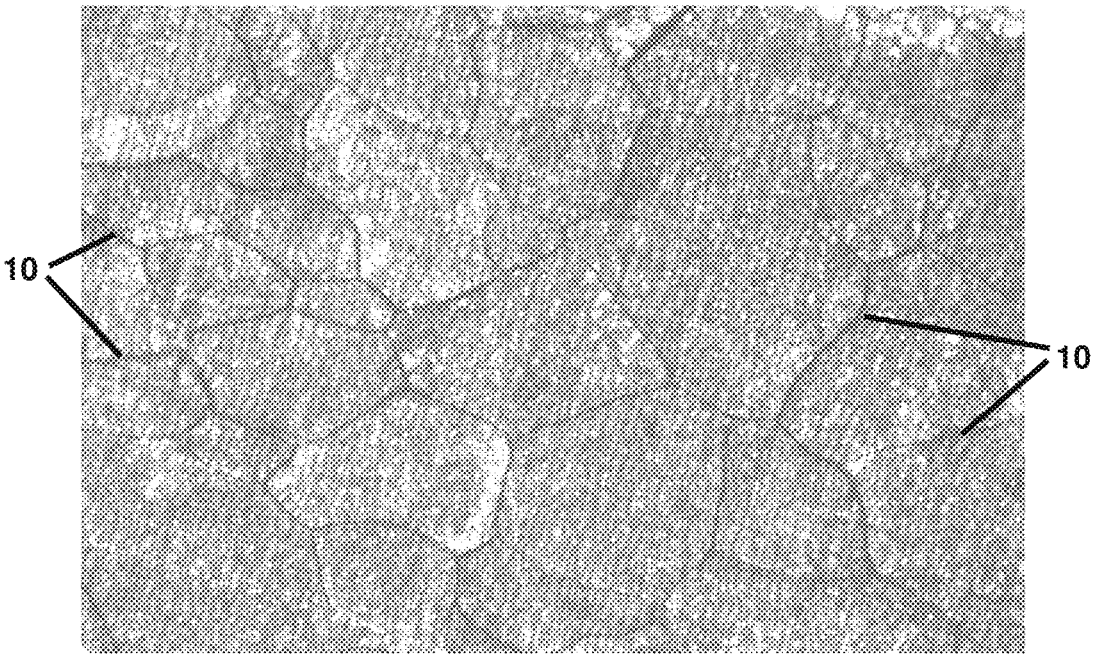
FIG. 4 is an image taken at 250× magnification showing an acid etched hot rolled exterior side surface of a martensitic thin metal (steel) strip, the surface including etched prior austenite grain boundary depressions without the presence of any elongated features consistent with low friction hot rolling, the strip having been formed using the twin roll casting process described in association with FIGS. 1 and 2, where the hot rolling was performed with a coefficient of friction below 0.20 at 60 meters per minute (m/min)
Figure 5:
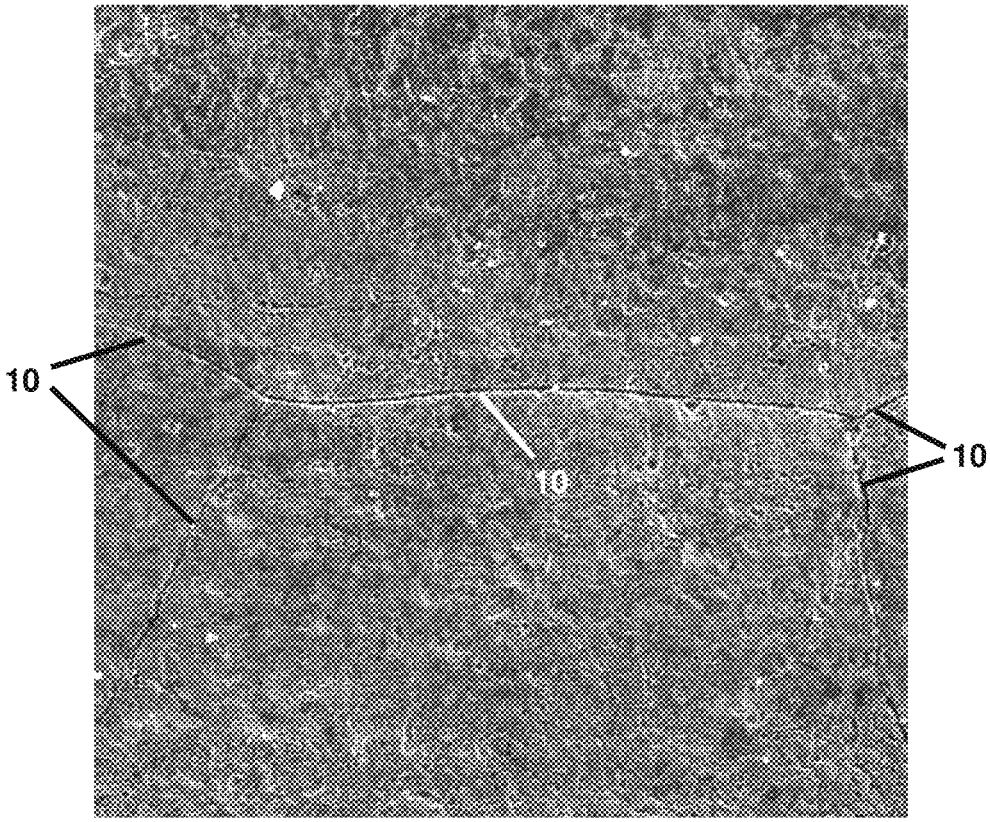
FIG. 5 is an image taken at 750× magnification showing an acid etched hot rolled exterior side surface of a martensitic thin metal (steel) strip, the surface including etched prior austenite grain boundary depressions without the presence of any elongated features consistent with low friction hot rolling, the strip having been formed using the twin roll casting process described in association with FIGS. 1 and 2, where the hot rolling was performed with a coefficient of friction below 0.20 at 60 meters per minute (m/min)

By way of example, various substrates forming thin metal strips were formed using a twin roll casting process. All substrates shown in FIGS. 3A-B were forming using the twin casting operation described above in association with FIGS. 1 and 2, where said substrates initially formed and hot rolled in the austenitic phase and thereafter cooled to form martensitic steel. The substrates as shown are martensitic and contain prior austenite grains, which may or may not be shown on the surface due to high friction hot rolling. In FIG. 4, a martensitic thin metal strip is shown with visible prior austenite grain boundaries 10 forming depressions after acid etching. The prior austenite grain boundaries 10 are substantially arranged along the hot rolled exterior side surface of the thin metal strip. This strip was hot rolled under low friction conditions, where hot rolling was performed with a coefficient of friction of below 0.20 while the substrate was entering the work rolls at 60 meters per minute (m/min). Thereafter, the strip was acid etched, resulting in the hot rolled exterior surfaces substantially including etched prior austenite grain boundaries as shown. No elongate structures are shown to be present. FIG. 5 shows in higher magnification (750×) a martensitic thin metal strip also produced under low friction conditions, mote clearly showing visible prior austenite grain boundaries 10 forming depressions after acid etching.

Figure 6:
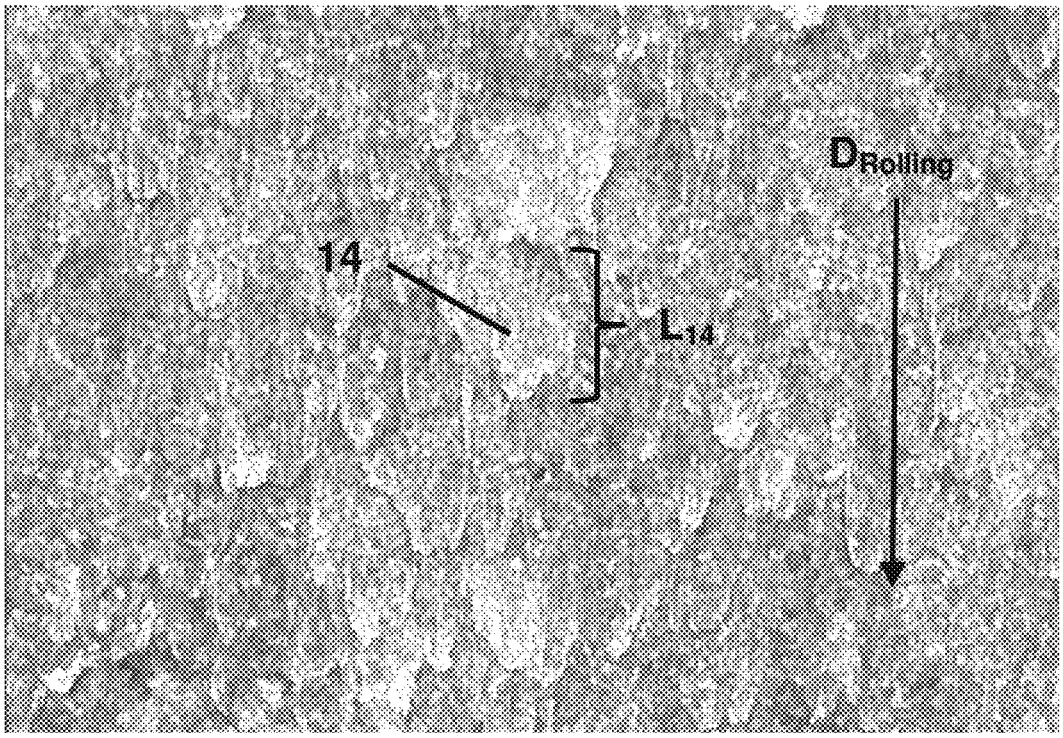
FIG. 6 is an image taken at 250× magnification showing an acid etched hot rolled exterior side surface of a martensitic thin metal (steel) strip being substantially free of prior austenite grain boundary depressions and separations, where said strip was formed using the twin roll casting process described in association with FIGS. 1 and 2, the hot rolling having been performed under high friction conditions with a coefficient of friction of 0.25 at 60 meters per minute (m/min) with a work roll force of approximately 820 tons.
Figure 7:
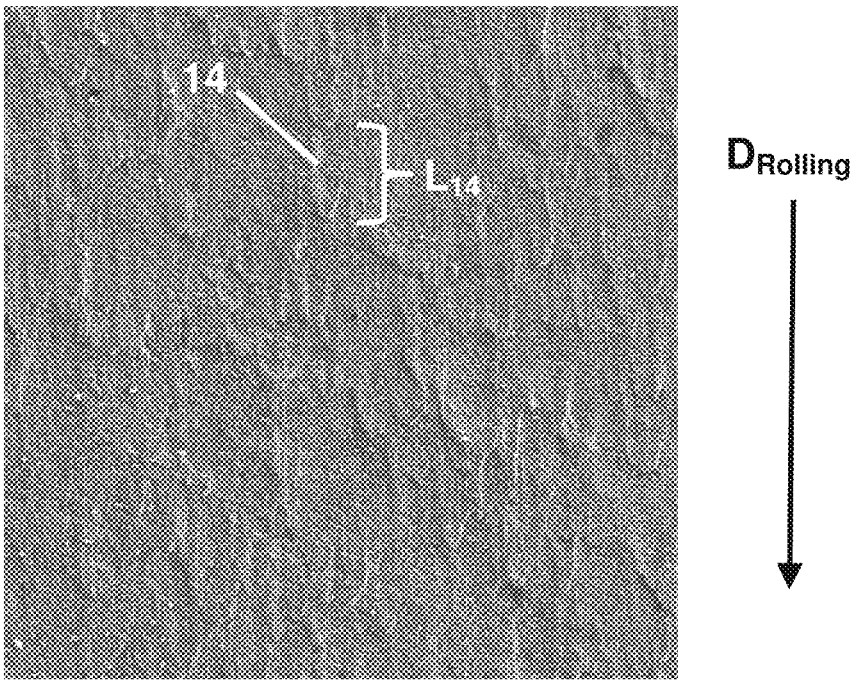
FIG. 7 is an image taken at 100× magnification using SEM (scanning electron microscopy) showing an acid etched hot rolled exterior side surface of a martensitic thin metal (steel) strip being substantially free of prior austenite grain boundary depressions and separations, where said strip was formed using the twin roll casting process described in association with FIGS. 1 and 2, the hot rolling having been performed under high friction conditions with a coefficient of friction of 0.268 at 60 meters per minute (m/min) with a work roll force of approximately 900 tons.
Figure 8:
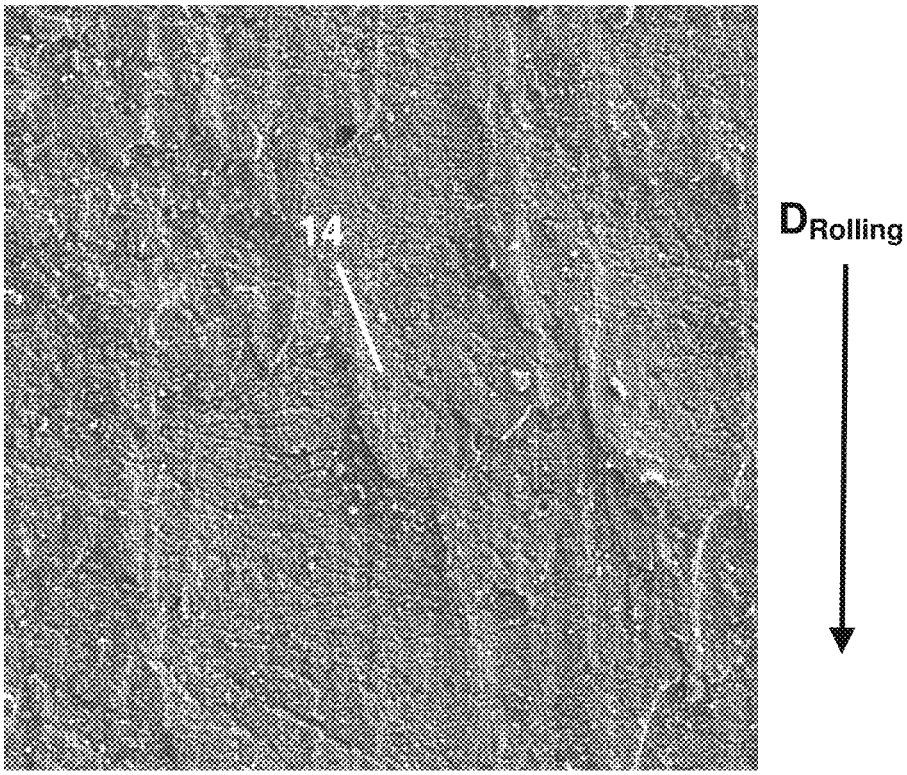
FIG. 8 is an image taken at 250× magnification using SEM (scanning electron microscopy) showing an acid etched hot rolled exterior side surface of a martensitic thin metal (steel) strip being substantially free of prior austenite grain boundary depressions and separations, where said strip was formed using the twin roll casting process described in association with FIGS. 1 and 2, the hot rolling having been performed under high friction conditions with a coefficient of friction of 0.268 at 60 meters per minute (m/min) with a work roll force of approximately 900 tons.
Figure 9:
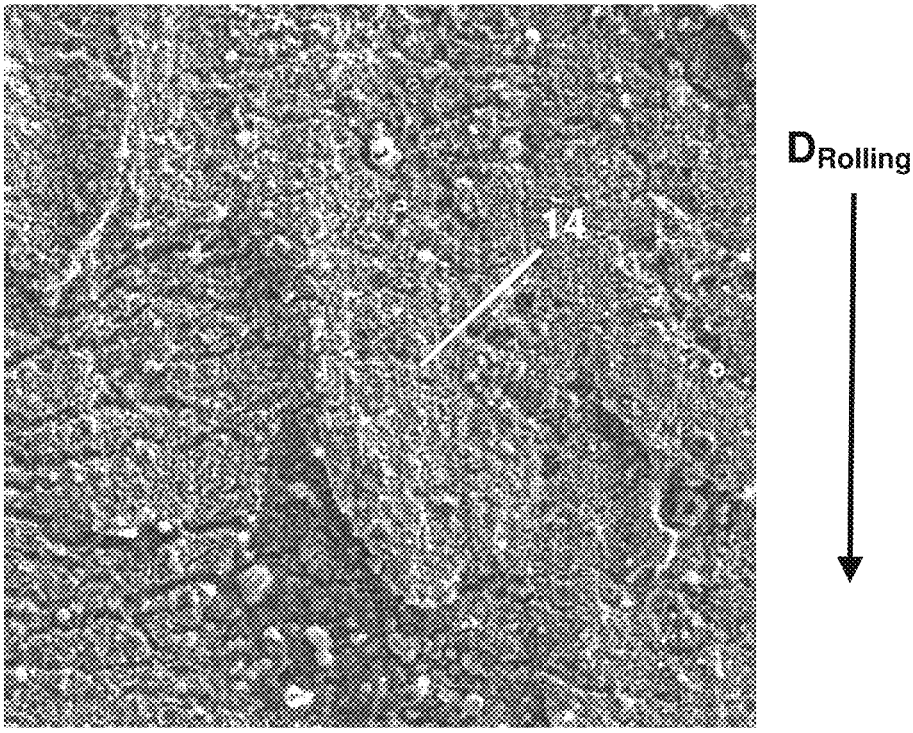
FIG. 9 is an image taken at 750× magnification using SEM (scanning electron microscopy) showing an acid etched hot rolled exterior side surface of a martensitic thin metal (steel) strip being substantially free of prior austenite grain boundary depressions and separations, where said strip was formed using the twin roll casting process described in association with FIGS. 1 and 2, the hot rolling having been performed under high friction conditions with a coefficient of friction of 0.268 at 60 meters per minute (m/min) with a work roll force of approximately 900 tons.
Figure 11:
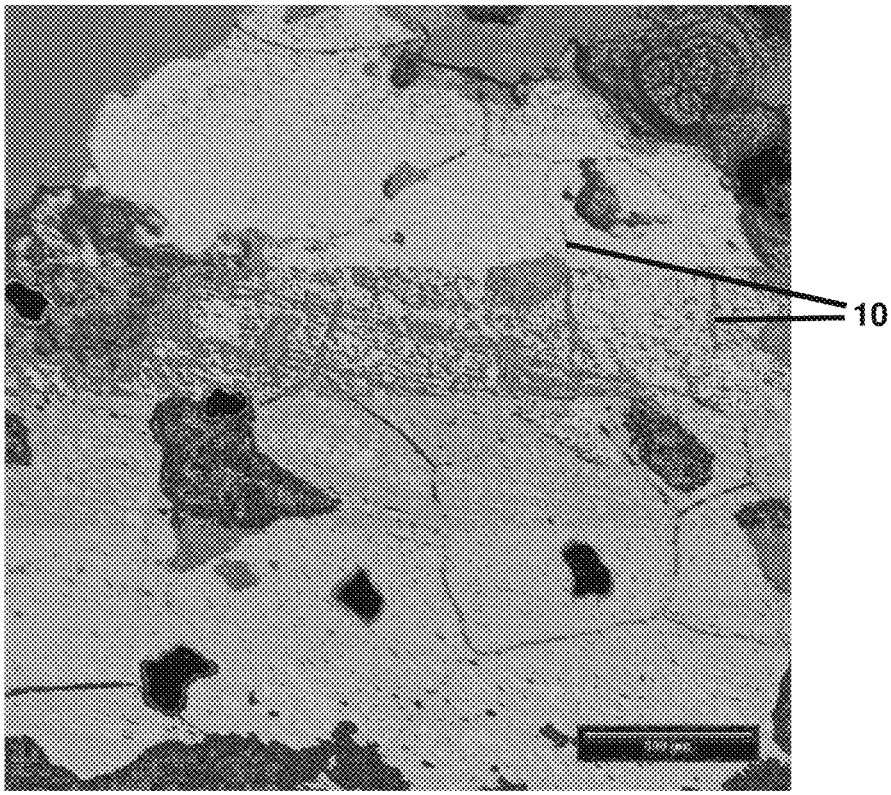
FIG. 11 is an image showing a non-acid etched hot rolled surface of a martensitic thin metal strip having prior austenite grain boundaries, where said strip was formed under low friction hot rolling conditions.

In FIG. 6, however, after hot rolling a substrate forming a thin metal strip while in an austenitic steel phase under high friction conditions (with a coefficient of friction was 0.25 while entering the work rolls at 60 meters per minute (m/min) at a reduction of 22% with an applied work roll force of 822 tons), the hot rolled surface is free of prior austenite grain boundaries—which is shown after acid etching. In other instances, a hot rolled surface substantially fee of prior austenite grain boundaries was attained for a martensitic thin metal strip when hot rolled under high friction conditions (where the coefficient of friction was 0.268 while entering the work rolls at 60 meters per minute (m/min) at a reduction of 22% with a work roll force of 900 tons). In FIG. 7, a hot rolled surface is free of prior austenite grain boundary after etching is shown at a lower magnification (100×). FIGS. 8 and 9 show hot rolled surface of FIG. 7 under higher magnification (250× and 750×, respectively), showing the a hot rolled surface is free of prior austenite grain boundaries after etching. FIG. 11 is shown for the purpose of establishing the presence of grains and prior austenite grain boundaries 10 without the need for acid etching or pickling. As noted elsewhere herein, acid etching and pickling is commonly used to remove oxidation scale after forming the cooled thin metal strip. Here, the oxidation scale is shown partially removed.

With continued reference to FIGS. 7-9, a plurality of elongate surface structure formations 14 are shown formed on the hot rolled surface, said structure is elongated in the direction of rolling $D_{rolling}$. With higher magnifications, it is clear that the elongated structure is a raised surface feature, generally forming a plateau which is consistent with plastic deformation under shear. Each opposing rolled exterior side surface shown in the figures can also be described as being homogenous, meaning, each side surface uniformly contains elongate structures without any prior austenite grain boundaries or cracks. Each opposing rolled exterior side surface can also be characterized in certain instances as having a surface roughness (Ra) of not more than 4 micrometers.

Figure 10:
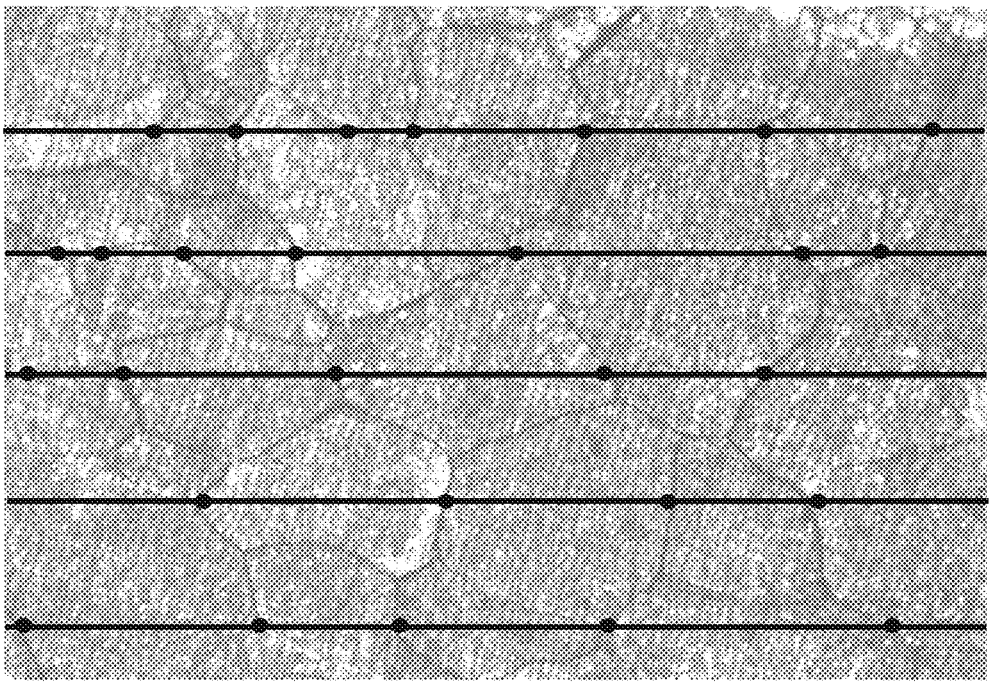
FIG. 10 is the image of FIG. 4 shown with an array of lines having lengths extending in a direction perpendicular to the rolling direction for use in determining the relative presence of prior austenite grain boundaries, where along each line a point is shown indicating a location where a prior austenite grain boundary intersects the line.

In association with FIG. 10, a procedure for determining whether a hot rolled surface is primarily or substantially free of prior austenite grain boundaries is described. First, an image is taken of the surface to be analyzed, which may or may not be of a predetermined size. Second, an array of parallel lines is arranged along the image. The lines in the array are spaced apart by a constant spacing, which may be of any desired distance. While the lines may extend lengthwise in any direction, in particular instances, the lines extend lengthwise in a direction perpendicular to the rolling direction (by way of example, see $D_{rolling}$ in FIGS. 7-9). Third, for each line, the quantity of intersections between the line and any grain boundary (which includes any visible prior austenite grain boundary) is determined. In FIG. 10, each intersection is identified by a point arranged along on each line. Fourth, the quantity of intersections occurring along each line is divided by the length of the line, and this step is repeated for each line in the array and an average is determined for all lines in the array. These steps 1-4 are then repeated for other one or more additional images taken along the same rolling surface to obtain an average value per line for all images analyzed along the surface. All images are to be taken at the same magnification. In particular instances, any number of images may be analyzed to arrive at the average intersection rate per length of line for the substrate surface. In particular instances, the image size may vary between images and/or the spacing between lines may vary between images. In other instances, the image size remains the same between images and optionally the spacing between lines remains constant between images. The average (intersection per length rate) for each image or for all images is then compared to an average intersection per length rate determined for the same thin metal strip having not been hot rolled to determine the extent of the presence of prior austenite grain boundaries. A higher average indicates the presence of more prior austenite grain boundaries. A threshold average intersection per length rate may be provided to determine what is and what is not primarily free of prior austenite grain boundaries and what is and what is not substantially free of prior austenite grain boundaries. It is appreciated that the images may be taken of a sample that is or is not acid etched (aka, pickled). It is also appreciated that the images may be obtained using any desired method, which includes without limitation SEM, TEM, LOM, AFM, or EBSD methods.

As identified above, other steels and steel alloys may be formed according to these methods, including for example and without limitation carbon steel strips. Examples of carbon steel strips include without limitation martensitic steels, high strength low alloy HSLA steels, and steels having an elevated niobium content. An illustrative example of a phase diagram for a carbon steel is available in a CALPHAD (Calculation of Phase Diagrams) method phase diagram published by Computational Thermal Dynamics Inc. and entitled as "Metastable Iron-Carbon (Fe-C) Phase Diagram." The Metastable Iron-Carbon (FE-C) Phase Diagram illustrates carbon steel is a steel that undergoes an austenite phase transformation. In other words, a carbon steel comprises a microstructure formed from prior austenite.

In view of the foregoing, the following are specific examples of the subject matter described and/or shown herein.

In one example, a method of making a carbon steel strip comprises assembling a pair of counter-rotatable casting rolls having casting surfaces laterally positioned to form a gap at a nip between the casting rolls through which a thin metal strip having a thickness of less than 5 mm can be cast; assembling a metal delivery system adapted to deliver molten metal above the nip to form a casting pool, the casting pool being supported on the casting surfaces of the pair of counter-rotatable casting rolls and confined at the ends of the casting rolls; delivering a molten metal to the metal delivery system; delivering the molten metal from metal delivery system above the nip to form the casting pool; counter rotating the pair of counter-rotatable casting rolls to form metal shells on the casting surfaces of the casting rolls that are brought together at the nip to deliver the thin metal strip downwardly, the thin metal strip having a thickness less than 5 mm; and hot rolling the thin metal strip using a pair of opposing work rolls, thereby creating opposing hot rolled exterior side surfaces of the thin metal strip primarily free of prior austenite grain boundaries and characterized as having a plurality of elongated surface structure formations formed by shear. The hot rolling may be performed with a coefficient of friction equal to or greater than 0.20 with or without the use of lubrication. After hot rolling the examples above, the opposing rolled exterior side surface of the thin metal strip are homogenous. In examples of the above, the surface roughness (Ra) of each of the opposing hot rolled exterior side surfaces is not more than 4 micrometers. In some examples of the above, the force applied to the thin metal strip during hot rolling is 600 to 2500 tons. In examples of the above, the thin metal strip translates, or advances, at a rate of 45 to 75 meters/minute while being hot rolled. In examples of the above, hot rolling may occur with the thin metal strip having a temperature of between 1050 to 1150° C. In examples of the above, the thin metal strip, after cooling, is characterized as having a tensile strength of 1100 to 2100 MPa, a yield strength of 900 to 1800 MPa, and an elongation to break of 3.5 to 8%. In examples of the above, less than 50% of each opposing hot rolled exterior side surface contains prior austenite grain boundaries. In examples of the above, 10% or less of each opposing hot rolled exterior side surface contains prior austenite grain boundaries. In examples of the above, opposing hot rolled exterior side surfaces of the thin metal strip are at least substantially free of prior austenite grain boundaries. In examples of the above, each opposing hot rolled exterior side surface is free of prior austenite grain boundaries.

In the method of making a thin metal strip of the prior examples the molten metal may comprise, by weight, 0.18% to 0.40% carbon, 0.7% to 1.2% manganese, 0.10% to 0.50% silicon, 0 to 0.1% vanadium, 0 to 0.1% niobium, 0 to 0.1% sulfur, 0 to 0.2% phosphorus, 0 to 0.5% chromium, 0.5 to 1.0% nickel, 0 to 0.5% copper, 0 to 0.15% molybdenum, 0 to 0.1% titanium, and 0 to 0.01 nitrogen. Further, the hot rolling may be performed at a temperature above the Ar3 temperature and where in creating opposing hot rolled exterior side surfaces of the thin metal strip substantially free of all prior austenite grain boundaries, the opposing hot rolled exterior side surfaces of the thin metal strip are substantially free of all prior austenite grain boundaries. Additionally, after the step of hot rolling, the method may comprise cooling the thin metal strip to a temperature equal to or less than a martensite start transformation temperature MS to thereby form martensite from prior austenite within the thin metal strip the thin metal strip, the thin metal strip being a martensitic steel thin metal strip.

The method of the above examples may further comprise identifying that the thin metal strip contains too many prior austenite grain boundaries prior to hot rolling the thin metal strip; and increasing the coefficient of friction when hot rolling the thin metal strip to primarily or substantially eliminate all prior austenite grain boundaries or at least all prior austenite grain boundaries. Moreover, in each of the above examples, the the plurality of elongated surface structure formations form a plateau.

In each of the above example, the coefficient of friction may be increased by increasing the surface roughness of the casting surfaces of the work rolls, eliminating the use of any lubrication, reducing the amount of lubrication used, or electing to use a particular type of lubrication.

In an example of a thin metal strip formed by the present disclosure, the thin metal strip comprises a thickness less than 5 mm and opposing exterior side surfaces primarily free of all prior austenite grain boundary and characterized as having a plurality of elongated surface structure formations elongated in a common direction, said common direction being a direction of hot rolling. In an example of the thin metal strip, each of the opposing exterior side surfaces of the thin metal strip may be homogenous. In additional examples of the thin metal strips above, the surface roughness (Ra) of each of the opposing hot rolled exterior side surfaces is not more than 4 micrometers.

In one example of the thin metal strips above, the thin metal strip, after cooling, may be characterized as having a tensile strength of 1100 to 2100 MPa, a yield strength of 900 to 1800 MPa, and an elongation to break of 3.5 to 8%. In examples of the thin metal strips above, at least less than 50% of each opposing hot rolled exterior side surface contains prior austenite grain boundaries. In examples of the thin metal strips above, opposing hot rolled exterior side surfaces of the thin metal strip are at least substantially free of prior austenite grain boundaries. In examples of the thin metal strips above, each opposing hot rolled exterior side surface is free of prior austenite grain boundaries. In examples of the thin metal strips above, the thin metal strips include, by weight, 0.18% to 0.40% carbon, 0.7% to 1.2% manganese, 0.10% to 0.50% silicon, 0 to 0.1% vanadium, 0 to 0.1% niobium, 0 to 0.1% sulfur, 0 to 0.2% phosphorus, 0 to 0.5% chromium, 0.5 to 1.0% nickel, 0 to 0.5% copper, 0 to 0.15% molybdenum, 0 to 0.1% titanium, and 0 to 0.01 nitrogen; the hot rolled exterior side surfaces of the thin metal strip are substantially free of all prior austenite grain boundaries; and the thin metal strip is a martensitic steel thin metal strip.

In yet another example of the thin metal strips above, the thin metal strip may be characterized as having a microstructure comprising a majority of bainite, and fine oxide particles of silicon and iron distributed though the microstructure of an average precipitate size less than 50 nanometers. The thin metal strip may be further characterized as having a tensile strength of at least 500 MPa, having a yield strength of at least 380 MPa, and having an elongation to break of at least 6% or 10%. This example may additionally be characterized as at least less than 50% of each opposing hot rolled exterior side surface contains prior austenite grain boundaries. Further, opposing hot rolled exterior side surfaces of the thin metal strip are at least substantially free of prior austenite grain boundaries. In examples of the thin metal strips above, each opposing hot rolled exterior side surface is free of prior austenite grain boundaries. In examples above, the thin metal strips may include, by weight, less than 0.25% carbon, 0.20 to 2.0% manganese, 0.05 to 0.50% silicon, less than or equal to 0.008% aluminum, and at least one element selected from the group consisting of titanium between 0.01 and 0.20%, niobium between 0.05 and 0.20%, and vanadium between about 0.01 and 0.20%, which may result in a High Strength Low Alloy (HSLA) thin metal strip.

In each of the examples of the thin metal strips above, each thin metal strip may be formed by the methods or processes additionally described above.

While it has been described with reference to certain examples, it will be understood by those skilled in the art that various changes may be made and equivalents may be substituted without departing from scope. In addition, many modifications may be made to adapt a particular situation or material to the teachings without departing from its scope. Therefore, it is intended that it not be limited to the particular examples disclosed, but that it will include all examples falling within the scope of the appended claims.

What is claimed is:

1. A method of making a carbon steel strip, the method comprising:

assembling a pair of counter-rotatable casting rolls having casting surfaces laterally positioned to form a gap at a nip between the casting rolls through which a thin metal strip having a thickness of less than 5 mm is cast, assembling a metal delivery system adapted to deliver molten metal above the nip to form a casting pool, the casting pool being supported on the casting surfaces of the pair of counter-rotatable casting rolls and confined at the ends of the casting rolls, delivering a molten metal to the metal delivery system;

delivering the molten metal from the metal delivery system above the nip to form the casting pool;

counter rotating the pair of counter-rotatable casting rolls to form metal shells on the casting surfaces of the casting rolls that are brought together at the nip to deliver the thin metal strip downwardly, the thin metal strip having a thickness less than 5 mm; and removing prior austenite grain boundaries by hot rolling the thin metal strip with a coefficient of friction equal to or greater than 0.20 using a pair of opposing work rolls, thereby creating opposing hot rolled exterior side surfaces of the thin metal strip primarily free of prior austenite grain boundaries and characterized as having a plurality of elongated surface structure formations formed by shear.

2. The method of claim 1, where the hot rolling is performed with use of lubrication.

3. The method of claim 1, where after hot rolling, the opposing rolled exterior side surfaces of the thin metal strip are homogenous.

4. The method of claim 1, where a surface roughness (Ra) of each of the opposing hot rolled exterior side surfaces is not more than 4 micrometers.

5. The method of claim 1, where a force applied to the thin metal strip during hot rolling is 600 to 2500 tons.

6. The method of claim 1, where the thin metal strip advances at a rate of 45 to 75 meters/minute while being hot rolled.

7. The method of claim 1, where the hot rolling occurs with the thin metal strip having a temperature of between 1050 to 1150° C.

8. The method of claim 1, where the thin metal strip, after cooling, is characterized as having a tensile strength of 1100 to 2100 MPa, a yield strength of 900 to 1800 MPa, and an elongation to break of 3.5 to 8%.

9. The method of claim 1, where the hot rolling is performed without use of lubrication.

10. The method of claim 1, where less than 50% of each opposing hot rolled exterior side surface contains prior austenite grain boundaries.

11. The method of claim 1, where 10% or less of each opposing hot rolled exterior side surface contains prior austenite grain boundaries.

12. The method of claim 1, where opposing hot rolled exterior side surfaces of the thin metal strip are at least substantially free of prior austenite grain boundaries.

13. The method of claim 1, where each opposing hot rolled exterior side surface is free of prior austenite grain boundaries.

14. The method of claim 1, where the molten metal comprises, by weight, 0.18% to 0.40% carbon, 0.7% to 1.2% manganese, 0.10% to 0.50% silicon, 0 to 0.1% vanadium, 0 to 0.1% niobium, 0 to 0.1% sulfur, 0 to 0.2% phosphorus, 0 to 0.5% chromium, 0.5 to 1.0% nickel, 0 to 0.5% copper, 0 to 0.15% molybdenum, 0 to 0.1% titanium, and 0 to 0.01 nitrogen;

where the hot rolling is performed at a temperature above the $Ar_3$ temperature and where in creating the opposing hot rolled exterior side surfaces of the thin metal strip substantially free of all prior austenite grain boundaries, the opposing hot rolled exterior side surfaces of the thin metal strip are substantially free of all prior austenite grain boundaries; and after the step of hot rolling, the method further comprises:

cooling the thin metal strip to a temperature equal to or less than a martensite start transformation temperature Ms to thereby form martensite from prior austenite within the thin metal strip, the thin metal strip being a martensitic steel thin metal strip.

15. The method of claim 1, where the molten metal comprises, by weight, less than 0.25% carbon, 0.20 to 2.0% manganese, 0.05 to 0.50% silicon, less than or equal to 0.008% aluminum, and at least one element selected from the group consisting of titanium between 0.01 and 0.20%, niobium between 0.05 and 0.20%, and vanadium between about 0.01 and 0.20%;

where the hot rolling is performed at a temperature above the $Ar_3$ temperature and where in creating the opposing hot rolled exterior side surfaces of the thin metal strip substantially free of all prior austenite grain boundaries, the opposing hot rolled exterior side surfaces of the thin metal strip are substantially free of all prior austenite grain boundaries; and where the thin metal strip may be characterized as having a microstructure comprising a majority of bainite, and fine oxide particles of silicon and iron distributed though the microstructure of an average precipitate size less than 50 nanometers, the thin metal strip being a HSLA thin metal strip.

16. The method of claim 1, where each of the plurality of elongated surface structure formations form a plateau.

17. The method of claim 1, where the method further comprises:

identifying that the thin metal strip contains prior austenite grain boundaries prior to hot rolling the thin metal strip; and if the thin metal strip contains prior austenite grain boundaries increasing the coefficient of friction when hot rolling the thin metal strip to primarily eliminate all prior austenite grain boundaries.

18. The method of claim 17 further comprising increasing the coefficient of friction when hot rolling the thin metal strip to substantially eliminate all prior austenite grain boundaries.

19. The method of claim 17, where the coefficient of friction is increased by increasing the surface roughness of the casting surfaces of the work rolls.

20. The method of claim 17, where the coefficient of friction is increased by reducing the amount of lubrication used.

21. The method of claim 17, where the coefficient of friction is increased by eliminating the use of any lubrication.

22. The method of claim 17, where the coefficient of friction is increased by electing to use a particular type of lubrication.

* * * * *